US009764495B2

(12) United States Patent
Gauthier et al.

(10) Patent No.: US 9,764,495 B2
(45) Date of Patent: Sep. 19, 2017

(54) MOLDING EQUIPMENT FOR MOLDING INTER-ENGAGING BRICKS AND METHOD OF USING THE SAME

(71) Applicant: Novabrik International Inc., Montreal (CA)

(72) Inventors: Simon Gauthier, Rosemere (CA); Dominic Chaussee, Montreal (CA); Luis Trelles Turgeon, Montreal (CA)

( * ) Notice: Subject to any disclaimer, the term of this patent is extended or adjusted under 35 U.S.C. 154(b) by 0 days.

(21) Appl. No.: 14/506,538

(22) Filed: Oct. 3, 2014

(65) Prior Publication Data

US 2015/0090861 A1 Apr. 2, 2015

Related U.S. Application Data

(63) Continuation-in-part of application No. 11/813,374, filed as application No. PCT/CA2006/000014 on Jan. 9, 2006, now abandoned.

(30) Foreign Application Priority Data

Jan. 11, 2005 (CA) ..... 2492250

(51) Int. Cl.
*B28B 7/24* (2006.01)
*B28B 7/00* (2006.01)
(Continued)

(52) U.S. Cl.
CPC ..... *B28B 7/241* (2013.01); *B28B 3/021* (2013.01); *B28B 3/06* (2013.01); *B28B 7/007* (2013.01);
(Continued)

(58) Field of Classification Search
CPC ..... B28B 7/24; B28B 7/241
(Continued)

(56) References Cited

U.S. PATENT DOCUMENTS 1,642,247 A * 9/1927 Krause ..... B28B 7/248 249/102
2,532,049 A 11/1950 Wittke
(Continued)

FOREIGN PATENT DOCUMENTS

CA 2220413 12/1996
CA 2254517 5/2000
(Continued)

*Primary Examiner* — Atul P. Khare
(74) *Attorney, Agent, or Firm* — Brouillette Legal Inc; Robert Brouillette

(57) ABSTRACT

A molding equipment and method to mold stackable inter-engaging bricks, blocks, stones and the like and bricks, blocks, stones and the like produced therewith are disclosed. The molding equipment comprises a main structure which contains individual cavities. Each cavity preferably has a middle structure to which a brick separating element can be attached. Without the brick separating element, each cavity can form two attached splittable bricks whereas with the brick separating element attached, each cavity can hold two individual smooth or embossed face bricks. The size and shape of the stackable inter-engaging bricks is such that once out of the mold but still in an uncured form, the brick can stand on its side without falling down, being damaged, buckling or being otherwise deformed during the manufacturing process.

19 Claims, 19 Drawing Sheets

(51) Int. Cl.

| | |
|---|---|
| ***B28B 3/02*** | (2006.01) |
| ***B28B 3/06*** | (2006.01) |
| ***B28B 15/00*** | (2006.01) |
| ***B30B 11/04*** | (2006.01) |
| *B28B 7/10* | (2006.01) |

(52) U.S. Cl.
CPC ..... *B28B 7/0079* (2013.01); *B28B 7/24* (2013.01); *B28B 15/005* (2013.01); *B30B 11/04* (2013.01)

(58) Field of Classification Search
USPC ..... 425/441, 443; 249/99, 129, 131
See application file for complete search history.

(56) References Cited

U.S. PATENT DOCUMENTS 3,017,683 A 1/1962 Huch et al.
3,354,592 A 11/1967 Curci
3,542,329 A * 11/1970 Ridenour ..... B28B 7/241 249/129
3,888,060 A * 6/1975 Haener ..... E04B 2/42 52/284
4,274,824 A * 6/1981 Mullins ..... B28B 7/183 425/253
4,335,549 A 6/1982 Dean, Jr.
5,062,610 A * 11/1991 Woolford ..... B28B 7/0097 249/119
5,297,772 A * 3/1994 Stefanick ..... B28B 7/0014 249/102
5,445,514 A * 8/1995 Heitz ..... B28B 7/0097 249/114.1
5,542,837 A * 8/1996 Johnston ..... B28B 7/366 249/102
5,771,631 A * 6/1998 Dawson ..... A01G 1/08 404/7
5,866,026 A * 2/1999 Johnston ..... B28B 7/0014 249/119
6,108,995 A * 8/2000 Bouchard ..... E02D 29/025 52/284
6,224,815 B1 5/2001 La Croix et al.
6,322,742 B1 11/2001 Bott
6,505,809 B1 * 1/2003 Reed ..... A21B 3/132 249/129
8,162,638 B2 * 4/2012 Stott ..... B28B 7/002 249/112
2003/0164574 A1 * 9/2003 Hammer ..... B28B 7/007 264/162
2003/0182011 A1 * 9/2003 Scherer ..... B28B 3/08 700/117
2005/0108973 A1 5/2005 Hammer et al.
2006/0145050 A1 * 7/2006 Price ..... B28B 7/0064 249/160

FOREIGN PATENT DOCUMENTS

CA WO 0026484 A1 * 5/2000 ..... E04B 2/02
CN 2346555 Y 11/1999
CN 1938134 A 7/2004
FR 8116262 11/1982
JP 10156824 A 6/1998
WO WO95/32083 A 11/1995
WO WO00/26484 A1 5/2000
WO WO2005009707 2/2005
WO WO2006074538 7/2006

* cited by examiner

MOLDING EQUIPMENT FOR MOLDING INTER-ENGAGING BRICKS AND METHOD OF USING THE SAME

CROSS-REFERENCE TO RELATED APPLICATIONS

The present patent application is a continuation-in-part of U.S. patent application Ser. No. 11/813,374, entitled "A MOLDING EQUIPMENT AND METHOD TO MANUFACTURE STACKABLE INTER-ENGAGING BRICKS, BLOCKS, STONES AND THE LIKE WITH A SMOOTH OR EMBOSSED FACE", and filed at the United State Patent and Trademark Office on Jan. 9, 2006, which claims the benefits of priority of Canadian Patent Application No. 2,492,250, entitled "A MOLDING EQUIPMENT AND METHOD TO MANUFACTURE STACKABLE INTER-ENGAGING BRICKS, BLOCKS, STONES AND THE LIKE WITH A SMOOTH OR EMBOSSED FACE", and filed at the Canadian Patent Office on Jan. 11, 2005, the content of which is incorporated herein by reference.

FIELD OF THE INVENTION

The present invention relates to the field of stackable inter-engaging bricks, blocks, stones and the like for building mortarless walls. This invention relates more precisely to the process of manufacturing individual smooth or embossed face or attached splittable inter-engaging bricks, blocks, stones and the like. As used herein, the word "bricks" also refers to blocks, stones and the like.

BACKGROUND OF THE INVENTION

Stackable inter-engaging bricks are used to build mortarless walls and this is known in the art. Wall building blocks which may be stacked and interlocked without being held together by a binding agent such as mortar are known. One such block has a top face which comprise a tongue element and a bottom face which comprise a mortise element. Both elements are configured in such a way that when two blocks are stacked, the bottom face of a block engages with the top face of a like block disposed below while the top face of the block engages with the bottom face of an above-disposed block. An example of such a block is shown in U.S. Pat. No. 6,108,995 (Bouchard et al.).

In the process of manufacturing stackable inter-engaging bricks 101 (FIG. 16), multiple attached splittable bricks made of brick material such as concrete are first cast in a metal mold. The molded attached brick units are then extracted from the mold 100 (FIG. 1) and conveyed through the manufacturing plant on steel or wood plates. The molded attached brick units are then cured in kilns in order to cure the brick material. Once cured, each of the attached bricks are detached in the middle in two individual split face bricks by the mean of a known splitting equipment. In this embodiment, every molded attached brick unit can produce two split face bricks.

The reason for manufacturing two split face bricks from a single attached splittable brick unit is found in the fact that, prior the completion of the curing procedure, an uncured single brick would be too fragile to be conveyed in the manufacturing plant without being unacceptably damaged or deformed in the process. Conveying uncured individual prior art bricks would result in an increase of defective or rejected bricks.

Also, the process of cutting attached brick units into individual bricks causes the bricks to have split faces, which may not be always desired.

The Bouchard mold, as the present mold, molds bricks standing on their side. It is important to understand that molding bricks on their side is not a simple design choice. As a matter of fact, inter-engaging bricks such as the bricks molded by the Bouchard mold are not held together by mortar. Such inter-engaging bricks are stacked rows upon rows in an inter-engaging manner. In that sense, the bricks are shaped such that the bottom portion of one brick is configured to engage the top portion of a brick located underneath.

The advantages of inter-engaging bricks are many. For instance, since they do not need mortar, their installation is typically much faster then regular mortar-held bricks. Also, such bricks can typically be installed by less skilled workers.

However, to provide a proper wall structure made from such inter-engaging bricks, it is important that the height of the brick, as viewed in their normal installed orientation, be constant, with low tolerance. Indeed, since such inter-engaging bricks are not held by mortar, the installer cannot use mortar to compensate for height variations between bricks during installation. Should the bricks have large height variations, the resulting wall constructed with such bricks would be misaligned as the cumulative effect of large height variations would be compounded over several rows of bricks.

Hence, by molding the bricks on their side, the bricks have very limited height variation but some length variations. However, variations in length are much less critical since bricks installed on the same row are installed side-by-side and any variation in length is or can be compensated for.

However, depending on the shape of the side section, bricks molded on their side can be unstable when standing on their side during the manufacturing process. In that sense, the shape of the side section of the bricks shown in Bouchard has been found to be somewhat unstable. The solution proposed in Bouchard was to link two bricks together with a bridging element. Once bridged, the overall side section of the bridged bricks is much more stable. Consequently, the bridged bricks can be carried around in the manufacturing plant with less risk of falling apart or being deformed, particularly in uncured state. In addition, the bridged bricks cannot rub against each other, preventing damages during transportation.

Still, the bridged bricks of Bouchard must be manually separated prior to installation. The manual separation involves the manual splitting of the bricks by hand and then the manual removal of the remaining portions of the bridge with a hammer. All these steps increase the manual labor required by the installers.

There is thus a need to find a mean by which stackable bricks could be molded, conveyed and cured individually without being damaged or deformed unacceptably and in such a way that the resulting brick faces could be smooth or embossed.

SUMMARY OF THE INVENTION

To overcome such shortcomings, the bricks resulting from the presently claimed molding equipment are individual in that they are not connected nor bridged as in the prior art. However, to achieve such a result, the individual bricks must be able to stand on their side in uncured state and be carried around without being damaged or otherwise deformed.

One of the main goals of the presently claimed invention is to provide a molding equipment capable of molding pairs of individual bricks suitably sized and shaped to be able to stand on their side in uncured form without being damaged or otherwise deformed during the manufacturing process.

After being molded, bricks, still uncured, travel through the manufacturing plant on steel plates. As they travel, the bricks are subjected to some shocks and vibrations. If the uncured bricks are too fragile, they will be damaged or otherwise deformed as they travel from the molding equipment to the kiln, thereby resulting in defective bricks to be discarded.

Another goal of the presently claimed invention is to have the molding equipment also capable of molding pairs of attached bricks, if needed.

The present invention discloses that when the individual bricks have a certain ratio of the side-section to the length, uncured bricks will be able to stand on their side and be carried around with less risks of being damaged or otherwise deformed.

According to an aspect of the present invention, using the shape of bricks as disclosed herein, a satisfactory ratio of approximately 26.65:1 must be used.

As such, the presently claimed invention comprises a molding equipment comprising a mold having a plurality of cavities, and removable brick separating elements configured to separate the cavities into two fully separated sub-cavities, each sub-cavity being configured to mold an individual brick standing on one of its sides.

According to another aspect of the invention, there is provided a molding equipment for molding multiple pairs of individual stackable inter-engaging bricks with a smooth or embossed face and without being damaged or deformed during molding, the molding equipment comprising:

a main body comprising cavities, each of the cavities being adapted to cast an appropriate material to produce the bricks, and each of the cavities comprising first attachment points; and brick separating elements distinct from the main body, each of the brick separating elements comprising an upper part configured to be secured to the main body, and comprising several brick separating plates extending downwardly from the upper part and being respectively attachable to the first attachment points of the cavities to create two fully separated sub-cavities in the cavities;

wherein the sub-cavities are configured to form bricks with an appropriate side-section area to brick length ratio of approximately 26.65:1 so as to prevent the bricks from being damaged or deformed during molding, and wherein each of the separated sub-cavities is adapted to mold individual smooth or embossed face bricks standing on one of their sides.

According to still another embodiment, there is provided a molding equipment for molding multiple pairs of individual stackable inter-engaging bricks with a smooth or embossed face and without being damaged or deformed during molding, the molding equipment comprising:

a main body comprising cavities, each of the cavities being adapted to cast an appropriate material to produce the bricks, and each of the cavities comprising first attachment points; and brick separating elements distinct from the main body, each of the brick separating elements comprising an upper part configured to be secured to the main body, and extending downwardly from the upper to the lower portion of the main body;

wherein brick separating elements are secured to the main body using dogs, wherein the sub-cavities are configured to form bricks and wherein each of the separated sub-cavities is adapted to mold individual smooth or embossed face bricks standing on one of their sides.

To attain these and other objects which will become more apparent as the description proceeds. According to one aspect of the present invention, a method to manufacture both individual smooth or embossed face bricks and attached splittable bricks is provided. Each of the bricks has a tongue interlock element and a mortise interlock element configured in such a way that the bricks are in a mutual engagement when bricks, blocks or stones or the like are stacked one of top of the other.

Molding equipment in accordance with the present invention comprises a mold having at least one and preferably a plurality of cavities. Each cavity allows the formation of a pair of splittable bricks. A brick separating element may be installed in the middle of each cavity to allow the formation of two individual free standing bricks. The brick separating element is typically secured in place by mean of a fastening device such as screws or bolts. Once the brick separating element is installed, the attached splittable brick cavity is effectively separated in two individual mold cavities.

The brick separating element has an upper part which contains openings. The openings are provided to receive fasteners such as screws or bolts. The fasteners are generally used to secure the brick separating element to the molding equipment main body.

The brick separating element is made from a hard and resistant material such as steel or cast iron.

The brick separating element can have a smooth surface or a surface with projection and/or cavities.

A method for manufacturing individual smooth or embossed face bricks using the molding equipment and the cavity separating element is also provided.

The method comprises: a) selecting the individual molds in which individual smooth face or embossed face bricks are to be molded, b) installing the smooth face brick separating element in the selected molds, c) installing the embossed face brick separating element in the selected molds, d) fastening the smooth face brick separating element with fasteners, e) fastening the embossed face brick separating element with fasteners, f) installing the molding equipment in the molding machine.

The invention accordingly comprises the construction, combination of elements, and arrangement of parts which will be exemplified in the construction herein set forth. Although the above summary describes more precisely the manufacturing of stackable inter-engaging bricks blocks, stones and the like to build mortarless wall on a structure, the present invention could also be used for example, to manufacture stackable inter-engaging bricks, blocks, stones and the like to build landscaping walls.

Other and further aspects and advantages of the present invention will be obvious upon an understanding of the illustrative embodiments about to be described or will be indicated in the appended claims, and various advantages not referred to herein will occur to one skilled in the art upon employment of the invention in practice.

BRIEF DESCRIPTION OF THE DRAWINGS

The above and other aspects, features and advantages of the invention will become more readily apparent from the following description, reference being made to the accompanying drawings in which.

DETAILED DESCRIPTION OF THE PREFERRED EMBODIMENT

A novel molding equipment for molding inter-engaging bricks and a method for using the same will be described hereinafter. Although the invention is described in terms of specific illustrative embodiments, it is to be understood that the embodiments described herein are by way of example only and that the scope of the invention is not intended to be limited thereby.

With reference to the annexed drawings, the preferred embodiments of the present invention will be herein described for indicative purposes and by no means as of limitation.

The drawings and the description attached to it are only intended to illustrate the idea of the invention. As to the details, the invention may vary within the scope of the claims. So, the size and shape of the individual stackable inter-engaging brick 1 (FIG. 6) may be chosen as desired, as long the size and shape enable the individual brick to stand on its side uncured as shown in FIG. 6 without falling over, being damaged, buckling or being otherwise deformed during the manufacturing process.

Figure 6:
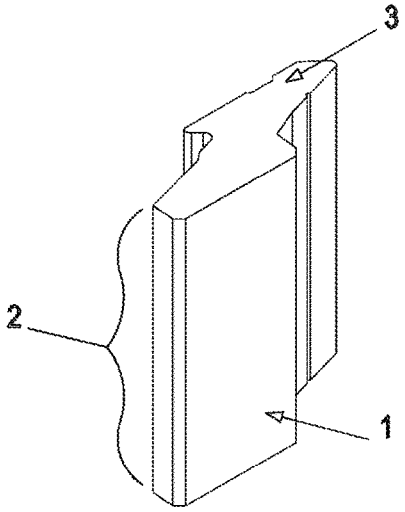
FIG. 6 is an isometric of a single smooth face stackable brick in accordance with the invention.
Figure 7:
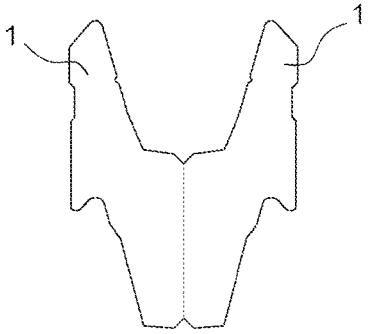
FIG. 7 is a top view of splittable bricks as produced in the molding equipment shown in FIG. 3.
Figure 8:
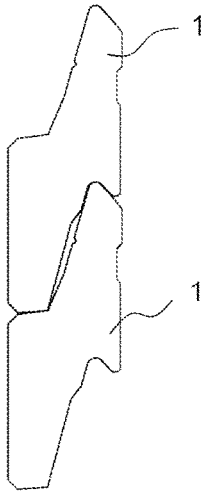
FIG. 8 is a side view of stacked bricks in accordance with the invention.
Figure 9:
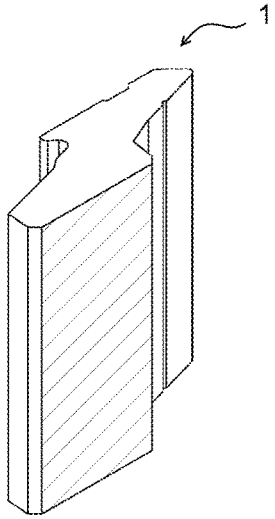
FIG. 9 is an isometric view of a single split face stackable brick in accordance with the invention.
Figure 10:
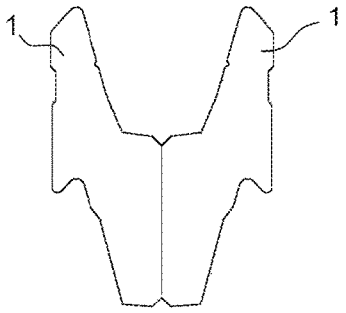
FIG. 10 is a top view of smooth (or embossed) face bricks as produced in the molding equipment shown in FIG. 4.
Figure 11:
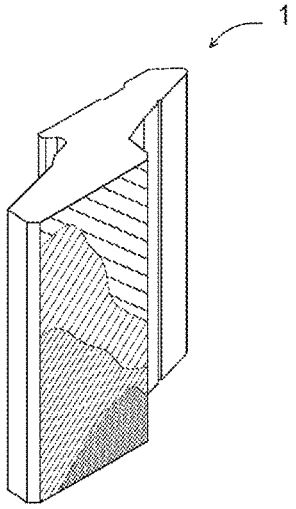
FIG. 11 is an isometric view of a single embossed face stackable brick in accordance with the invention.

Referring to FIG. 6, for a single individual stackable inter-engaging brick 1 having the present side-section shape 3 shown will stand on its side uncured without falling over, being damaged, buckling or being otherwise deformed during the manufacturing process if the side-section area 3 to the brick length 2 ratio is 26.65:1. As such, for a brick of this shape, a ratio of approximately 26.65:1 is preferred to provide an optimal standing brick. However, given other brick characteristics such as brick material, brick shape, brick side-section inertia momentum and brick length according to FIG. 6, the ratio would be different.

Figure 1:
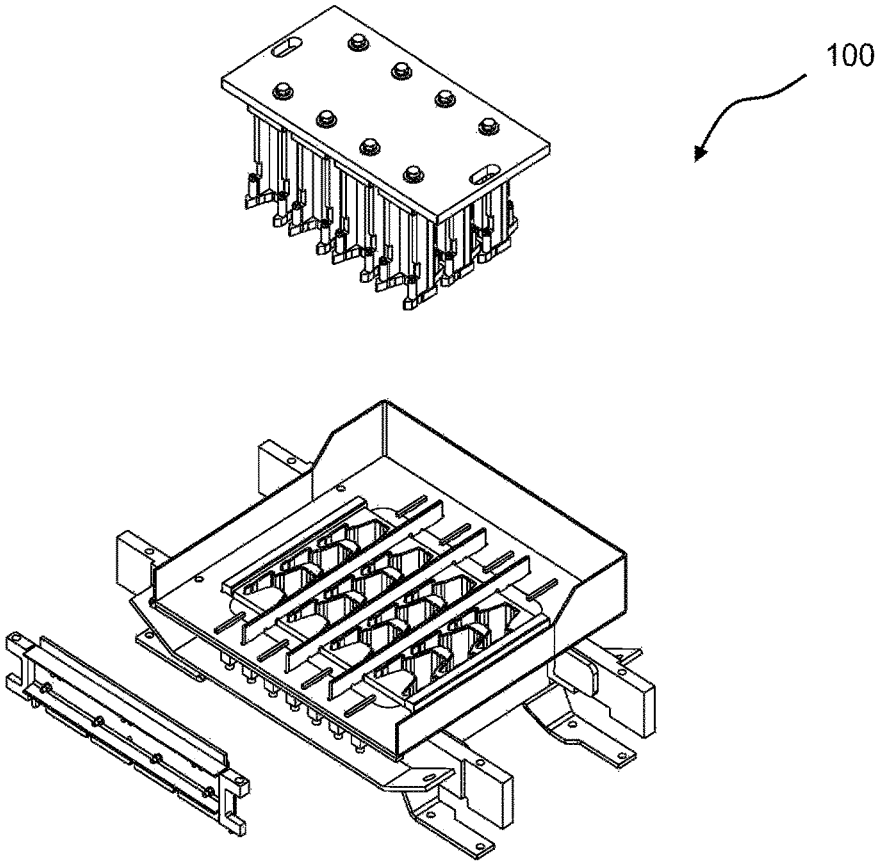
FIG. 1 is an isometric view of prior art molding equipment used to manufacture splittable stackable inter-engaging bricks.
Figure 2:
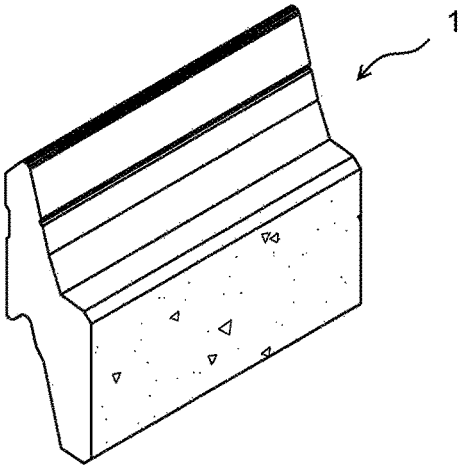
FIG. 2 is an isometric view of an individual stackable inter-engaging brick.
Figure 3:
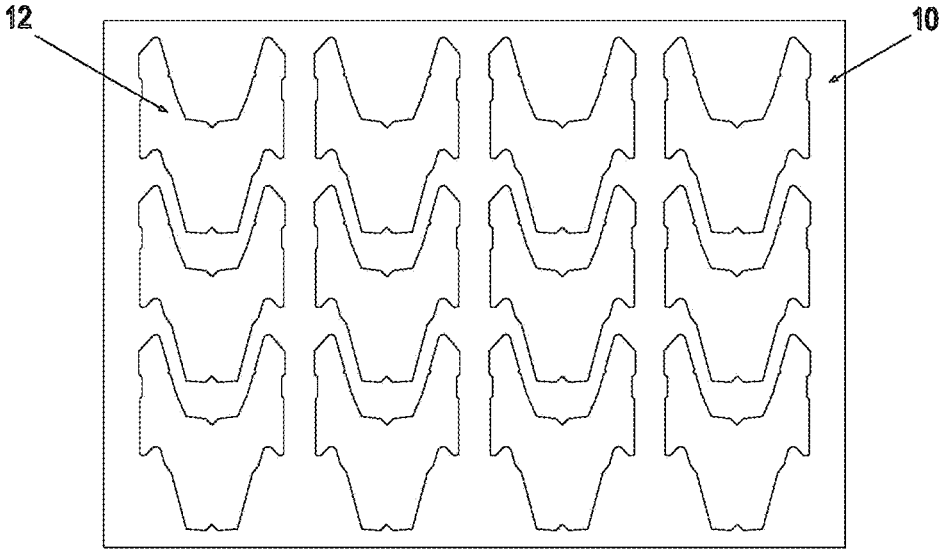
FIG. 3 is a top view of molding equipment to be used in manufacturing splittable stackable inter-engaging bricks in accordance with the present invention.
Figure 4:
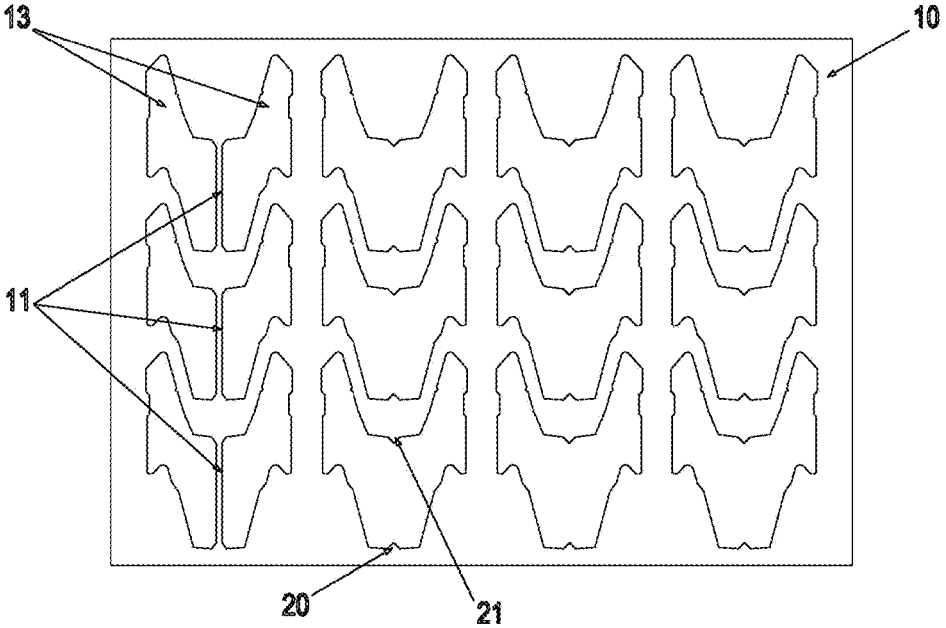
FIG. 4 is a top view of the molding equipment to be used in manufacturing individual smooth (or embossed) face stackable inter-engaging bricks in accordance with the invention.
Figure 5:
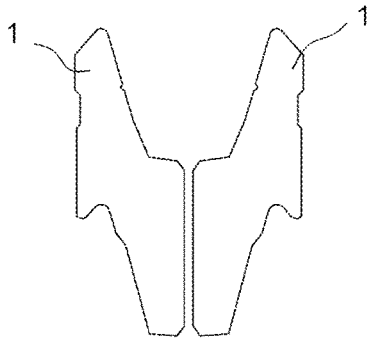
FIG. 5 is a top view of two individual smooth (or embossed) face stackable inter-engaging bricks as produced in the molding equipment shown in FIG. 4.

Referring to FIGS. 3 and 4, the molding equipment main body 10 is illustrated. Several cavities 12 are created in the molding equipment main body 10. The cavities 12 are used to cast the concrete or other appropriate material to produce bricks (not shown here).

FIG. 3 shows molding equipment for producing splittable brick units. However, in FIG. 4, a brick separating element 11 has been attached to the mold 12 (see FIG. 3) at attachment points 20 and 21. The brick separating element 11 attached at attachment points 20 and 21 thus creates two separated cavities 13 to mold individual smooth or embossed face bricks.

Figure 12:
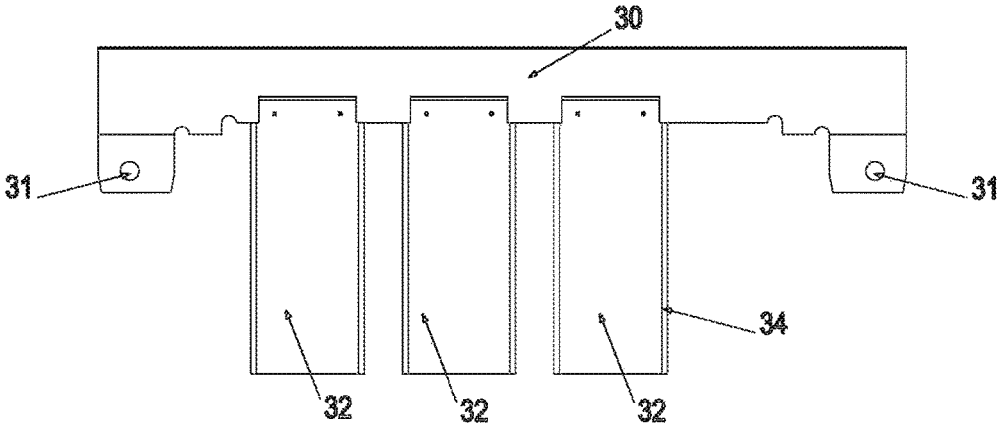
FIG. 12 is an isometric view of the brick separating element to be used in manufacturing smooth face stackable inter-engaging bricks.

FIG. 12 shows the brick separating element used to manufacture individual smooth face bricks. The upper part 30 of the brick separating element has openings 31 at both ends of the upper part to secure the brick separating element to the molding equipment main body 10 (see FIGS. 3 and 4). The brick separating element may have several brick separating plates 32.

Figure 13:
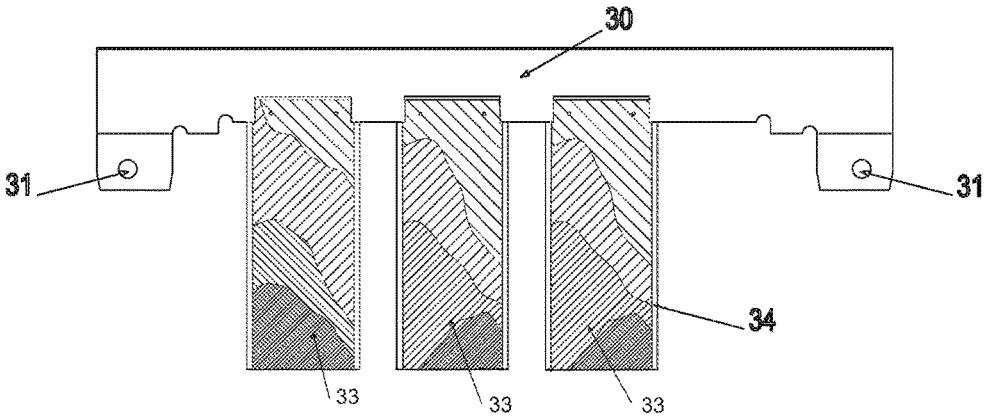
FIG. 13 is an isometric view of the brick separating element to be used in manufacturing embossed face stackable inter-engaging bricks.
Figure 14:
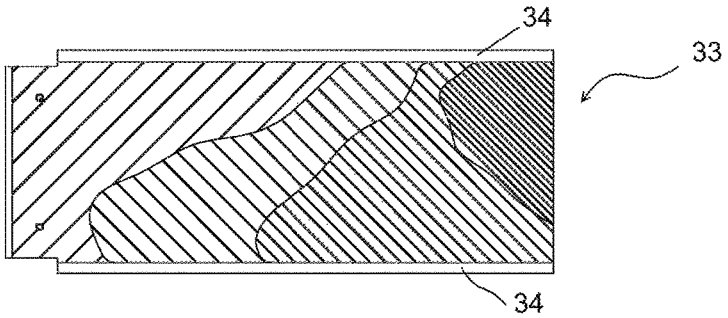
FIG. 14 is a side view of one brick separating plate to be used in manufacturing embossed face stackable inter-engaging bricks.
Figure 15:
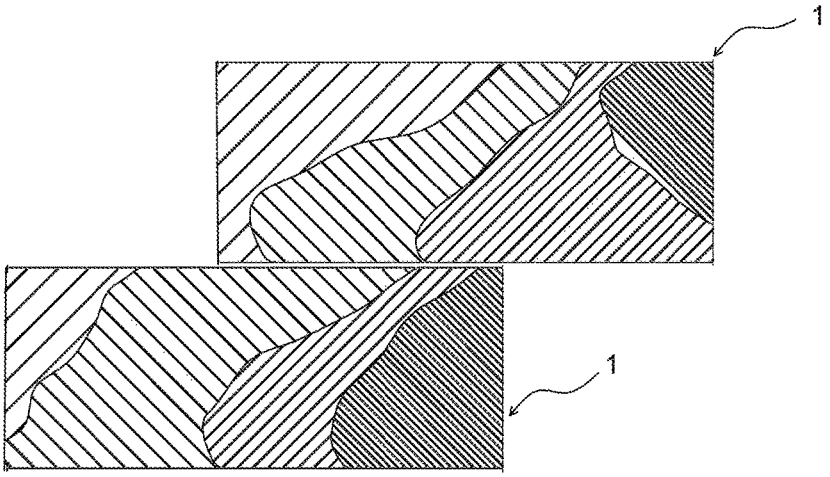
FIG. 15 is a side view of a possible pattern created by using several embossed face stackable inter-engaging bricks.
Figure 16:
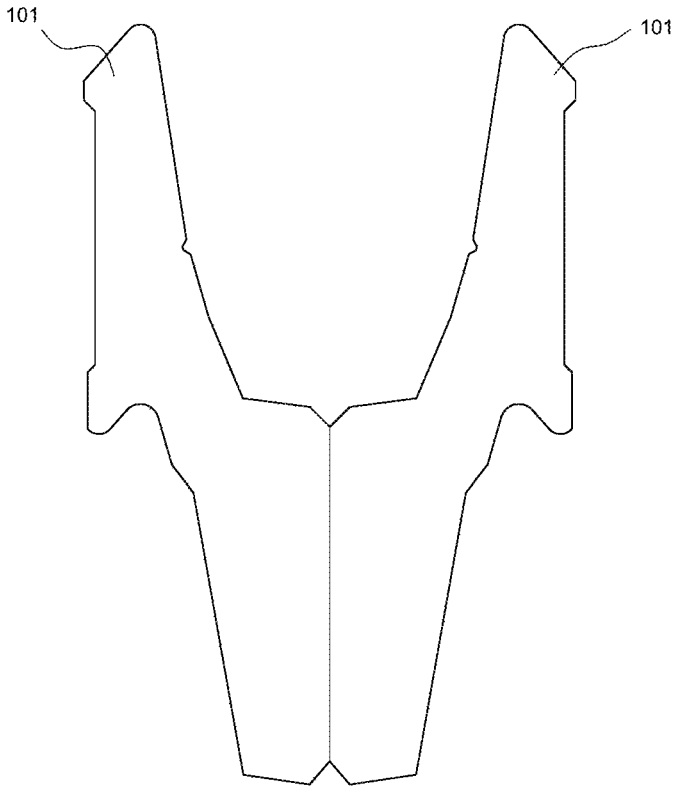
FIG. 16 is a top view of a prior art splittable stackable inter-engaging bricks as produced by a prior art molding equipment.

FIG. 13 shows the brick separating element used to manufacture individual embossed face bricks. The upper part 30 of the brick separating element has openings 31 at both ends of the upper part to secure the brick separating element to the molding equipment main body 10 (see FIGS. 3 and 4). The brick separating element may have several brick separating plates 33.

Referring to FIGS. 12 and 13, smooth 32 and embossed 33 brick separating plates are illustrated. The smooth 32 and embossed 33 brick separating plates have "V" shaped grooves 34 on each side to secure each brick separating plate 32/33 in the molding equipment main body 10 (see FIGS. 3 and 4).

Notably, in the presently claimed invention, the brick separating elements 11 fully separate the cavities 21 into two fully separated sub-cavities. Moreover, the bricks resulting from the molding equipment are fully separated and do not need any additional splitting step.

Figure 17:
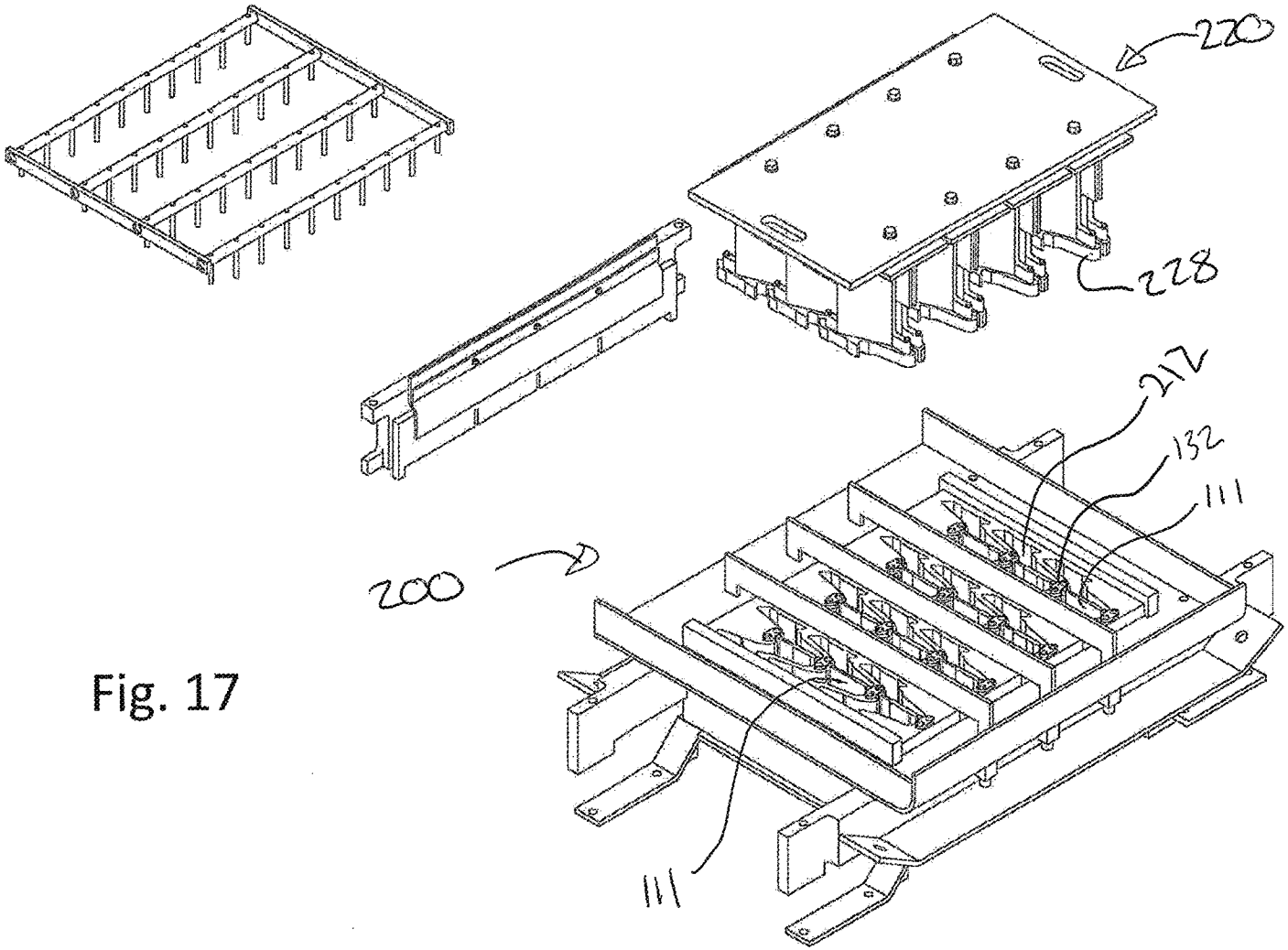
FIG. 17 is an isometric view of a molding equipment to manufacture splittable stackable inter-engaging bricks according to the present invention.
Figure 18:
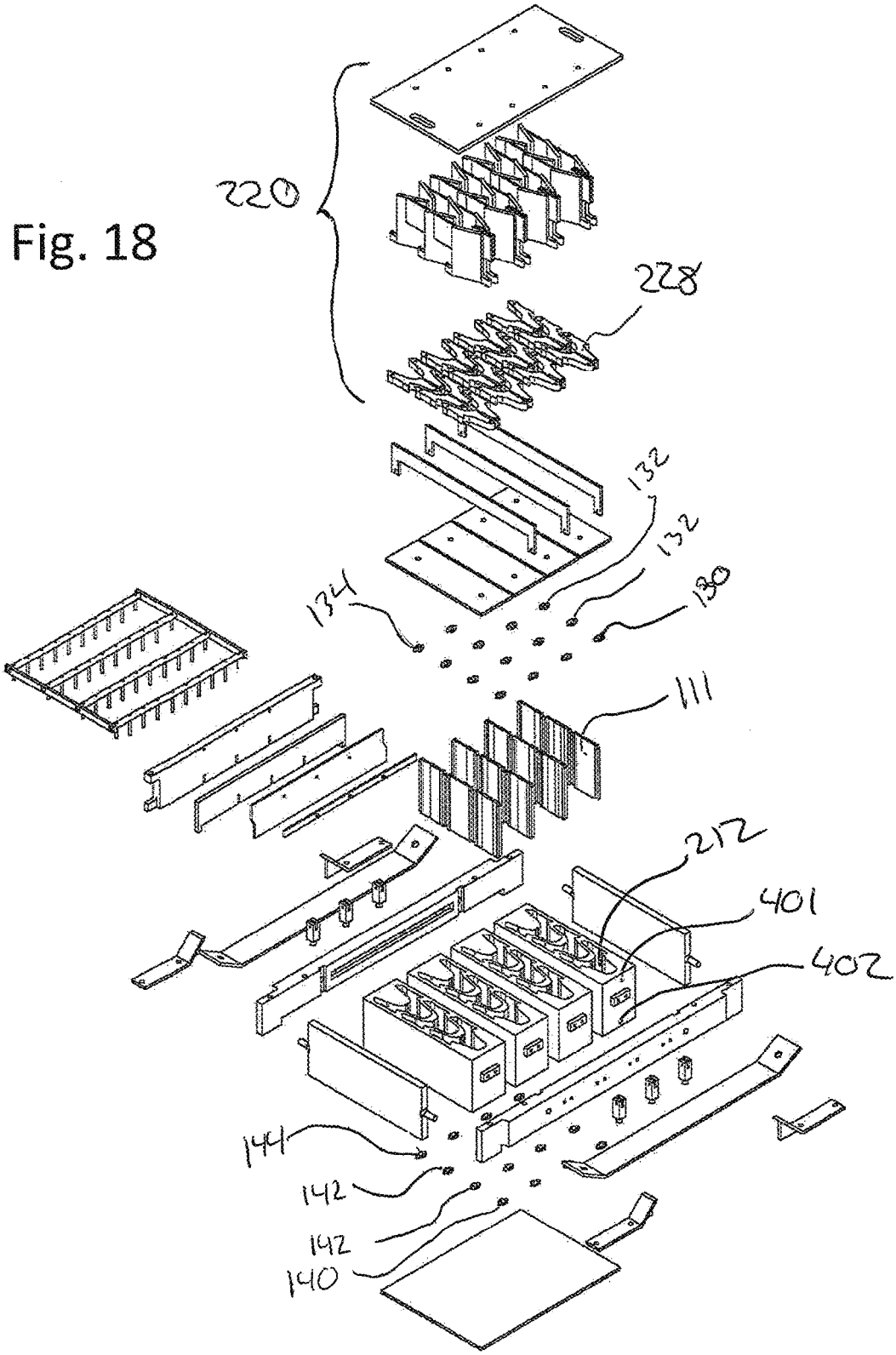
FIG. 18 is an exploded view of the molding equipment shown in FIG. 17.
Figure 19:
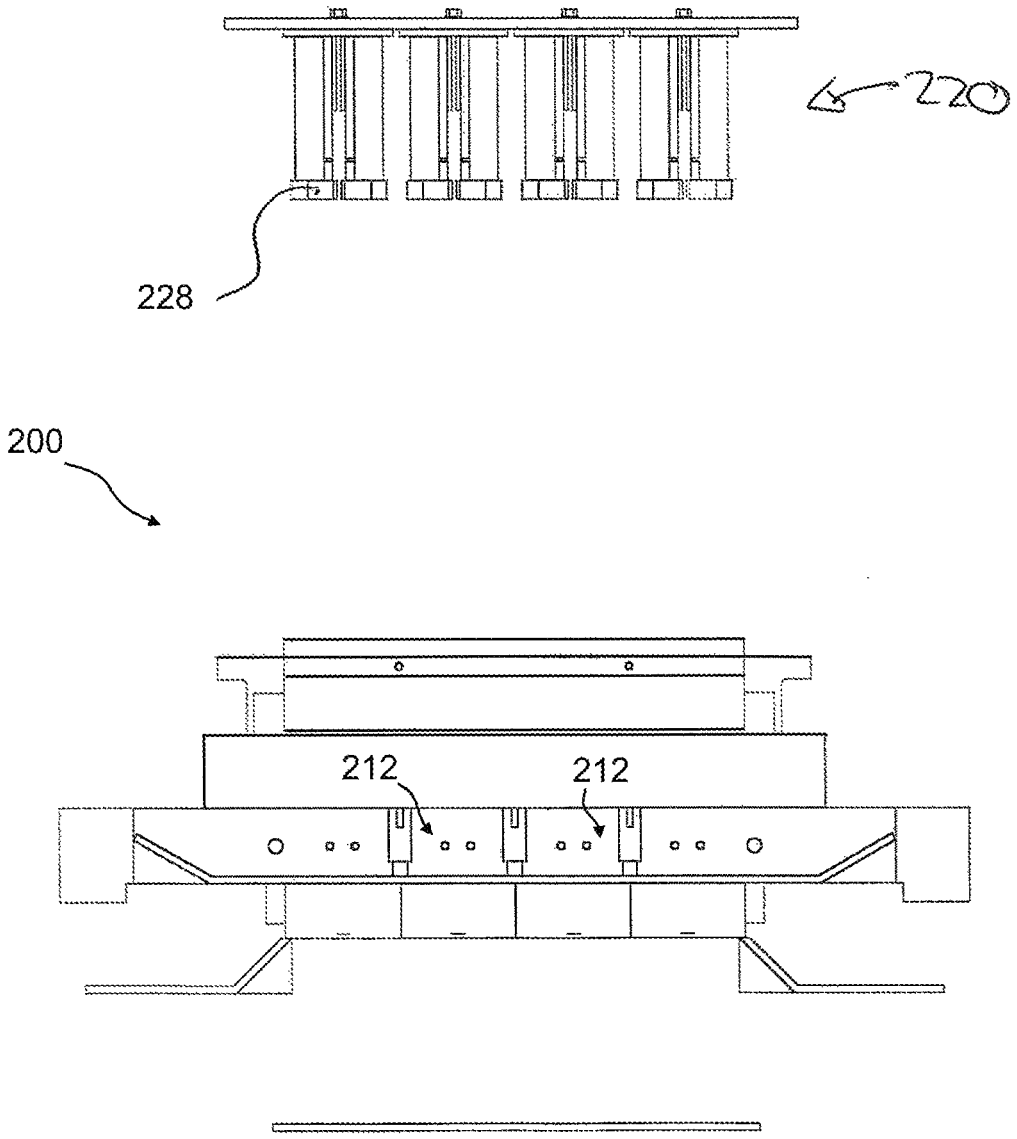
FIG. 19 is a front elevation view of the molding equipment shown in FIG. 17.
Figure 20:
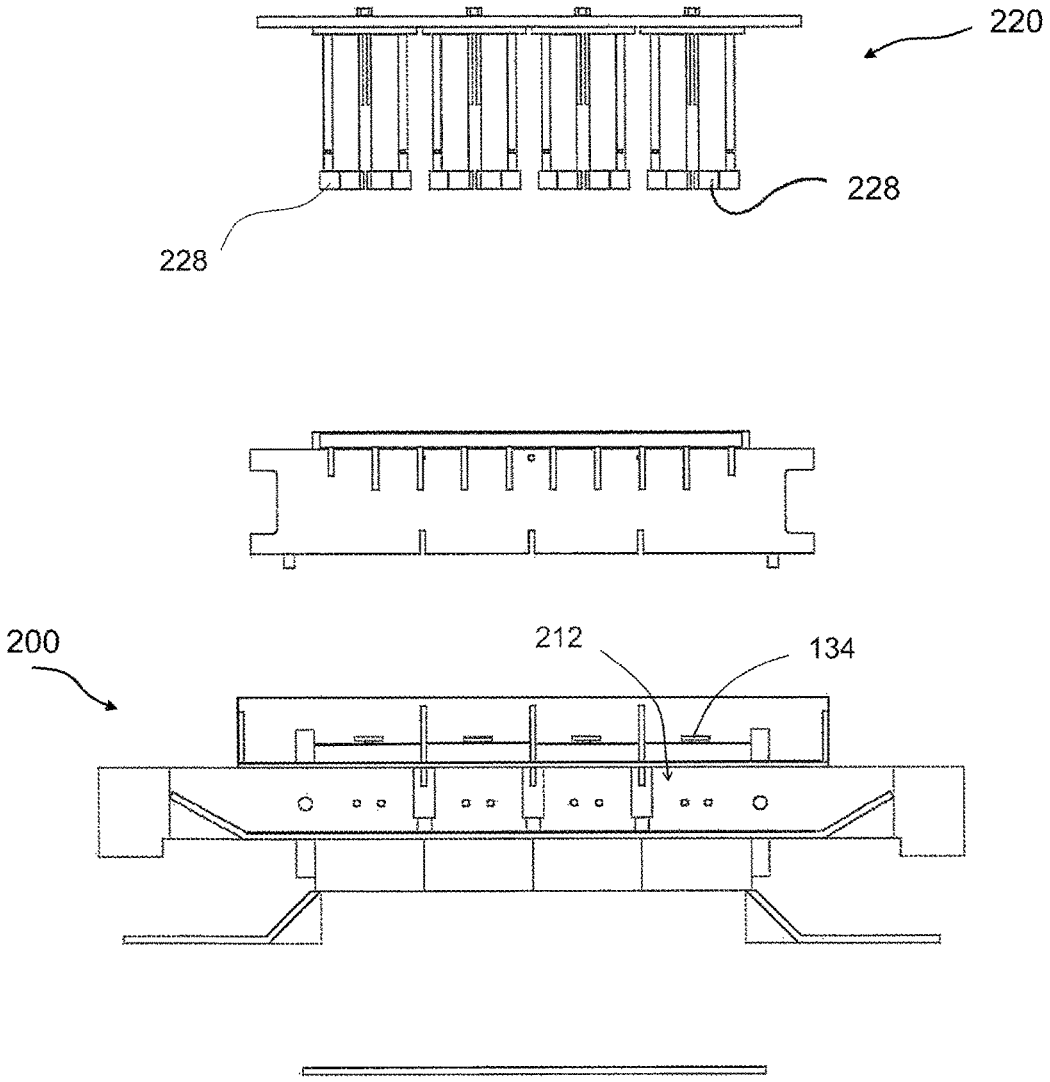
FIG. 20 is a rear elevation view of the molding equipment shown in FIG. 17.
Figure 21:
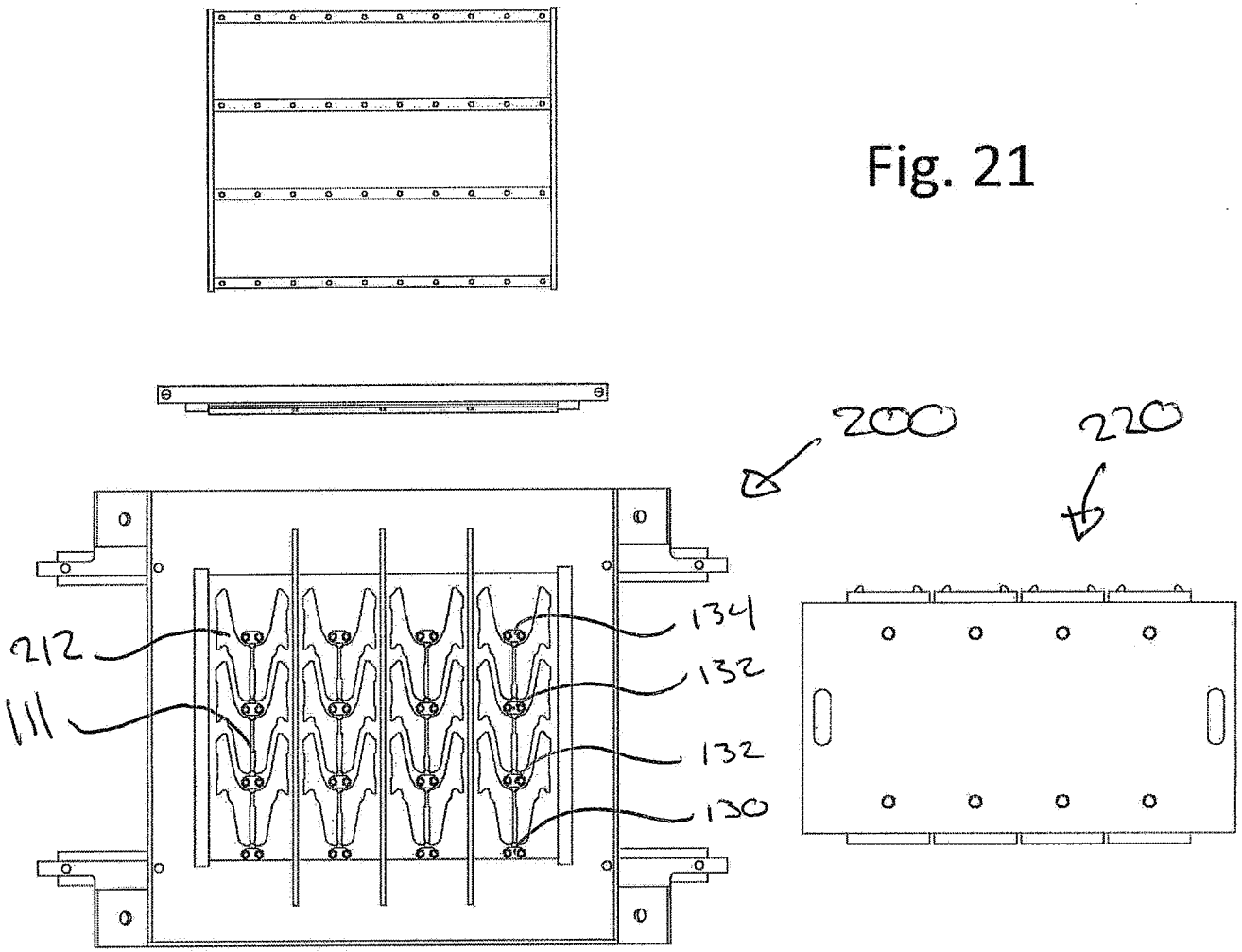
FIG. 21 is a top plan view of the molding equipment shown in FIG. 17.

Now referring to FIGS. 17-18, according to another embodiment of the present invention if shown a novel molding equipment used to manufacture splittable stackable inter-engaging bricks 1. The molding equipment used to manufacture splittable stackable inter-engaging bricks 1 comprises a main body 200 and a brick extraction module 220.

The main body 200 further comprises at least one, preferably a plurality of molding blocks having a series of moulding cavities for the manufacture splittable stackable inter-engaging bricks 1. According to the present invention, the moulding cavities may be used for the manufacture of splittable stackable inter-engaging bricks 1 or may additionally comprise a middle plate 111 used to mold the brick without any further splitting required. According to this latter embodiment, the mortarless inter stackable bricks 1 are typically manufacture using a similar molding cavity whereas the user employ a fixation system for securing the separating plates 111, to the molding blocks.

The fixation system referred herein comprises dog elements designed to secure the separating elements, such as separating plates 111, to the molding blocks. The separating elements are inserted in the molding cavities of the molding blocks. The separating elements are than secured using an upper and lower dog respectively located on top and below the separating elements. The dogs are generally fixated to the molding blocks using at least one, preferably two fasteners. Depending on the configuration of the molding blocks there may be various types of dogs. In the present embodiment, three different types of upper 130, 132, 134 and lower 140, 142, 144 dogs are used. The first upper dogs type 130 are located toward the lowed portion of the inter-engaging stackable brick 1, the second upper dogs type 132 are overlapping two mold cavities and the third upper dogs types 134 are at the top of the upper portion of the decorative brick portion. Similarly, according to the present embodiment, the first lower dogs type 140 are located toward the lowed portion of the inter-engaging stackable brick 1, the second lower dogs type 142 are overlapping two mold cavities and the third lower dogs types 144 are at the top of the upper portion of the decorative brick portion. Understandably, depending on the configuration of the molding blocks and the molding cavity one could according to another embodiment without departing with the principle of the present invention, envision a dog designed to be universal thus having the ability to fit in all dog securing positions.

According one aspect of the present embodiment, the same mold cavities may be utilised for the manufacture of both mortarless stackable inter-engaging bricks 1 and mortarless splittable stackable inter-engaging bricks 1. In the former mortarless inter-engaging stackable bricks 1 the dogs 130, 132, 134, 140, 142, 144 will be used in combination with separating plates 111 whereas in the later mortarless splittable inter-engaging stackable bricks 1 the dogs 130, 132, 134, 140, 142, 144 will be used in combination with elongated "v" shaped inducing member 120.

According to one embodiment, to account for the use of the present dogs 130, 132, 134, 140, 142, 144, the molding blocks and molding cavities 212 preferably have grooves for mating with the protruding portion 160 of the elongated "v" shaped inducing member 120 or the protruding portion 170 of the plate 111. These protruding portions 160, 170 are preferably used to respectively insure secure fixation of the elongated "v" shaped inducing member 120 and plate 111 to the mold during use of the molding equipment.

According to one aspect of the present embodiment, the groove inducing portion 120 and plates 111 generally have indentations 113, 114, 112, 115 on their lower and upper portion as to mate with the groove or plate 111 securing portions of the dogs 130, 132, 134, 140, 142, 144.

The separating plates 111 may be of various kind to produce different patterns or textures. They optionally also may be flat. In addition, the separating plates 111 typically comprise a portion inducing part of the "v" groove shape the stackable inter-engaging bricks preferably have.

Now referring to FIGS. 17-22 is shown the brick extraction module 220 having a lower head portion 228 substantially corresponding to the shape of the stackable inter-engaging bricks. The lower head 228 could be used for both individual mortarless stackable inter-engaging bricks 1 and mortarless splittable stackable inter-engaging bricks 1. However, for mortarless splittable stackable inter-engaging bricks 1, a different head without any void 240 separating both portions of the head 228*a* and 228*b* would be preferred.

As such, the present invention typically allows one molding block and molding cavities to be used for various king of stackable inter-engaging bricks.

Figure 23:
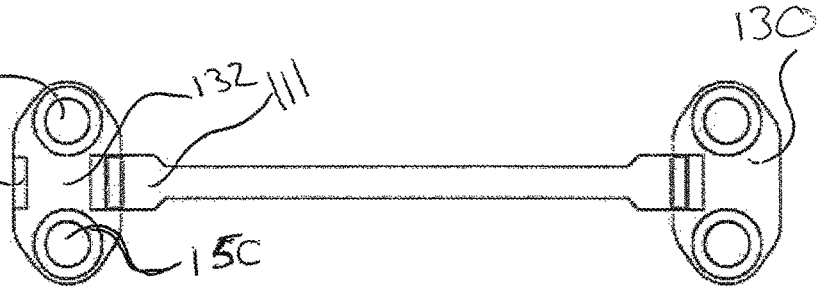
FIG. 23 is a top view of a plate holding element.
Figure 24:
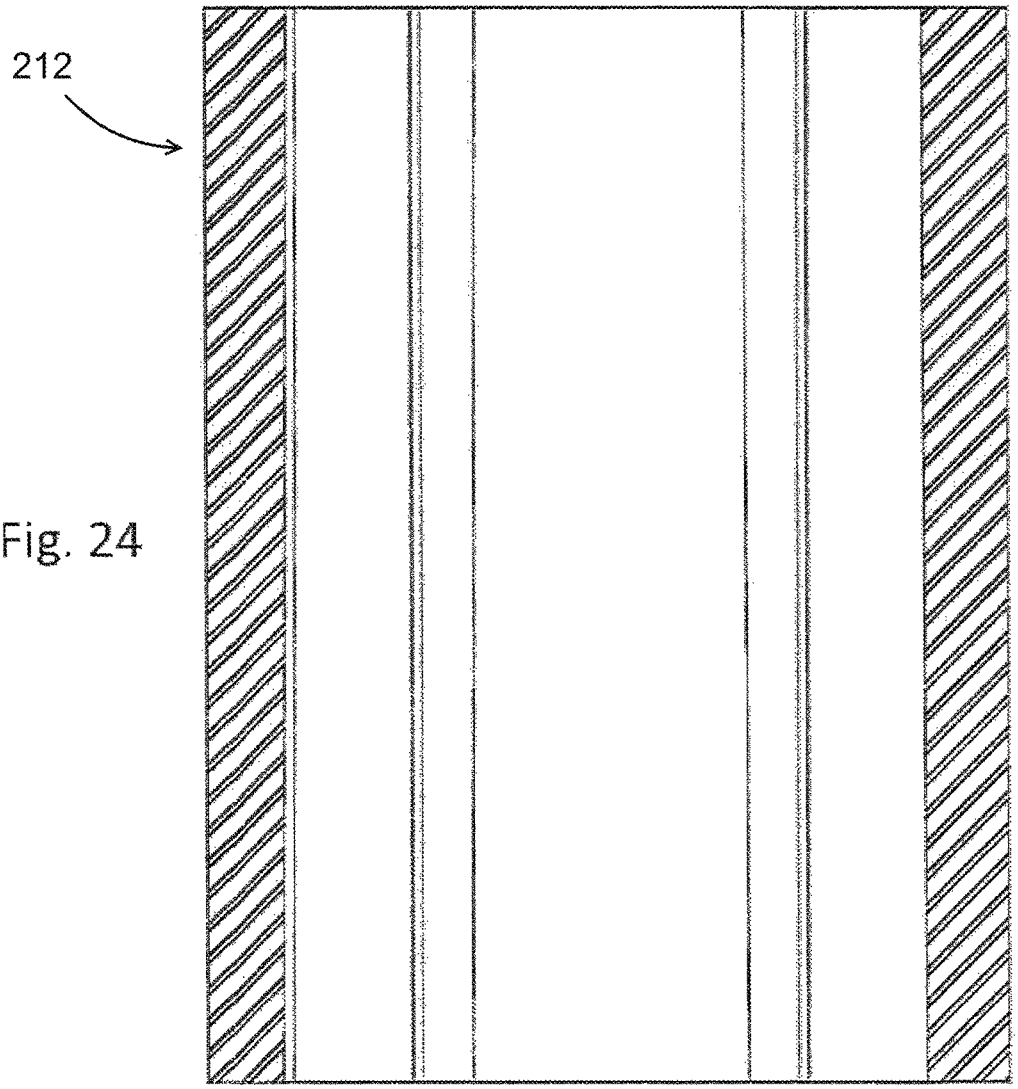
FIG. 24 is a cross sectional view of the molding cavity.

Referring to FIG. 23, different types of dogs are shown securing a separating plate 111. The dogs shown in this embodiment each comprise two dog securing element or fasteners 150, 152. The various type of dogs 130, 132, 134, 140, 142, 144 also comprise at least one indentation 180 mating the plate 111 or elongated "v" shaped inducing member 120.

Figure 25:
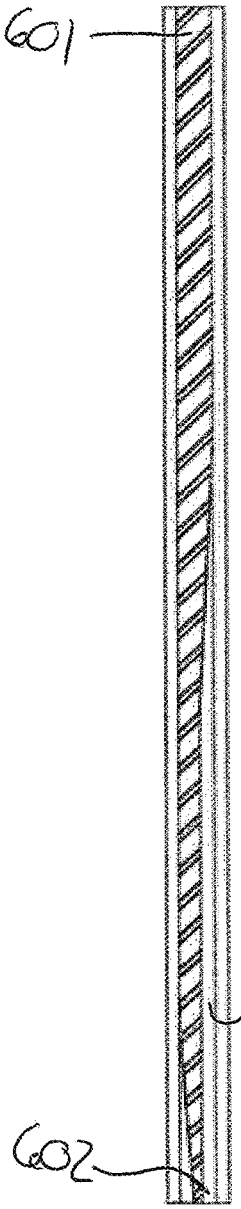
FIG. 25 is a cross sectional view of a splitting plate for an embossed brick.
Figure 26:
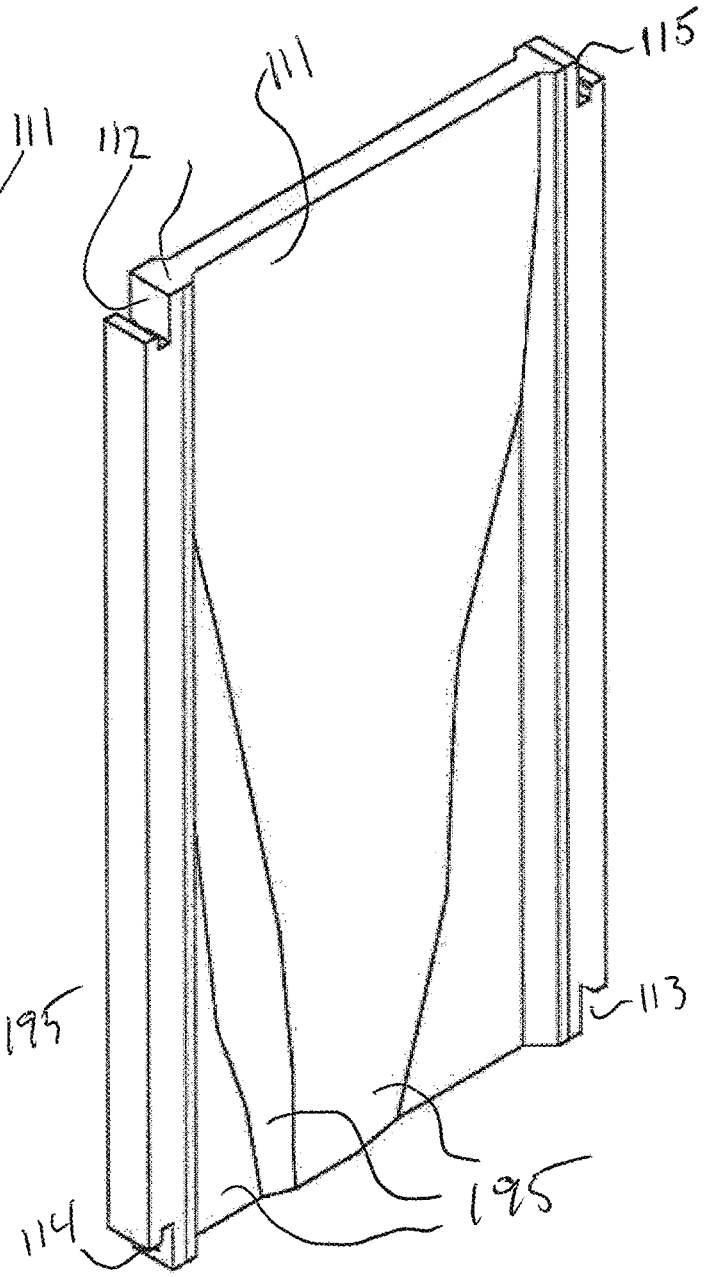
FIG. 26 is a perspective view of the splitting plate for an embossed brick.
Figures 27, 28:
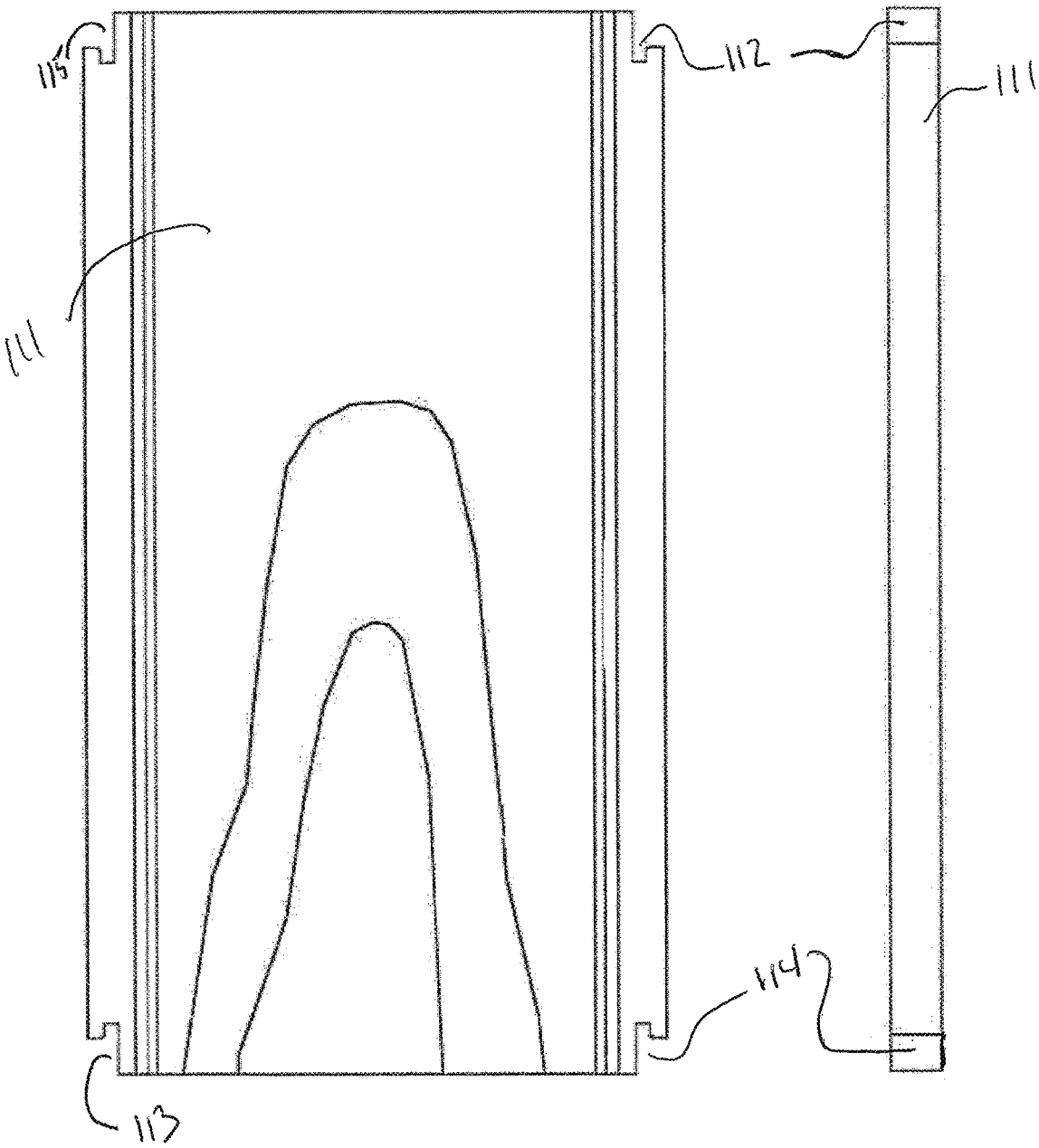
FIG. 27 is a rear view of the splitting plate of FIG. 26.
FIG. 28 is a side elevation view of the splitting plate of FIG. 26.
Figure 29:
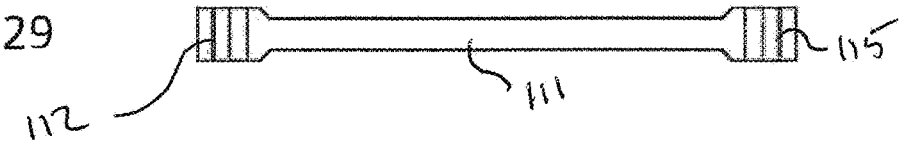
FIG. 29 is top plan view of the splitting plate of FIG. 26.
Figure 30:
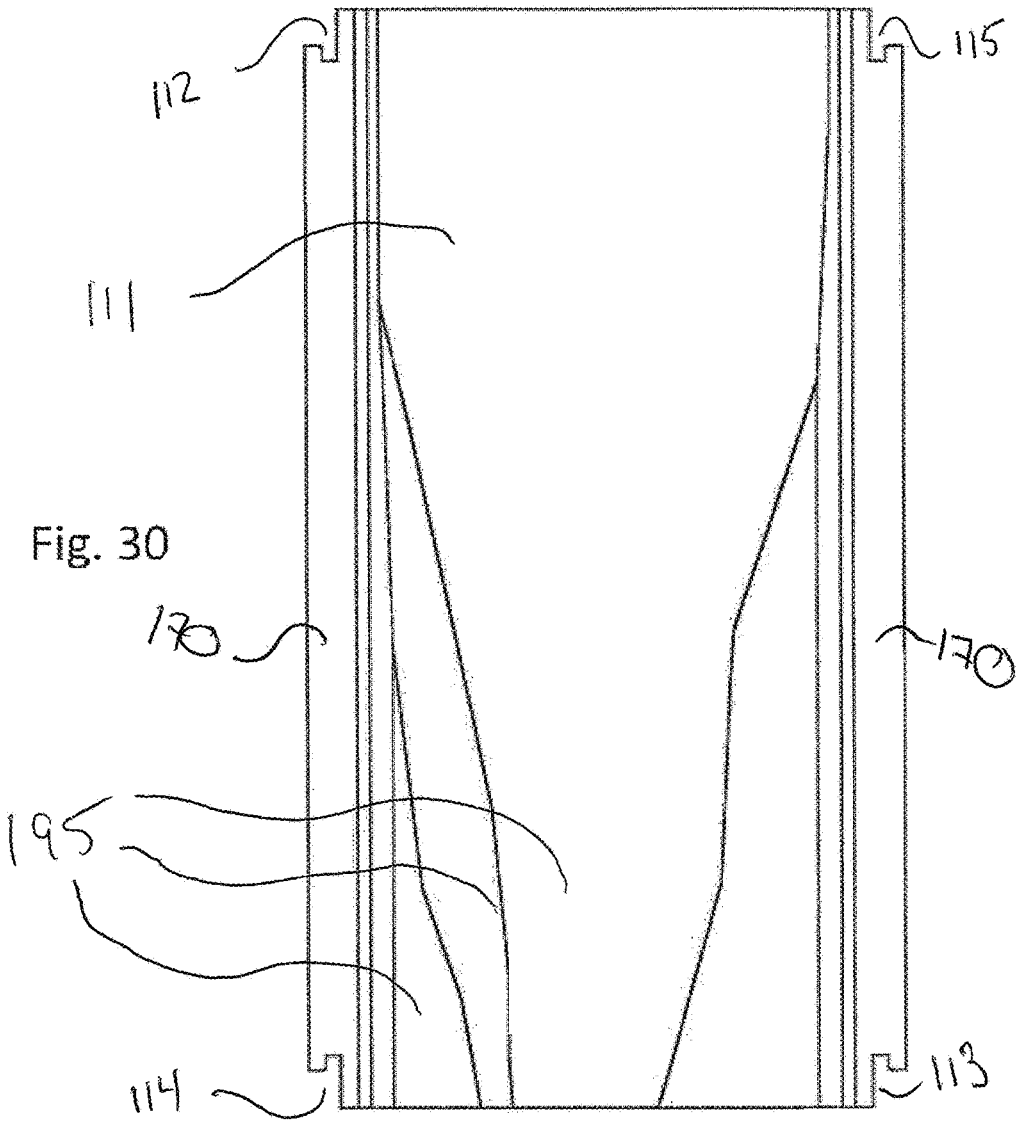
FIG. 30 is a front elevation view of the splitting plate of FIG. 26.
Figure 31:
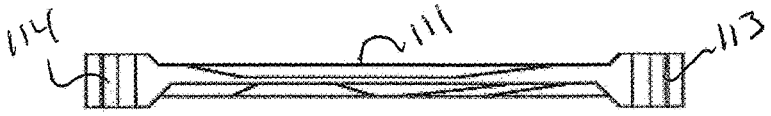
FIG. 31 is bottom plan view of the splitting plate of FIG. 26.
Figure 32:
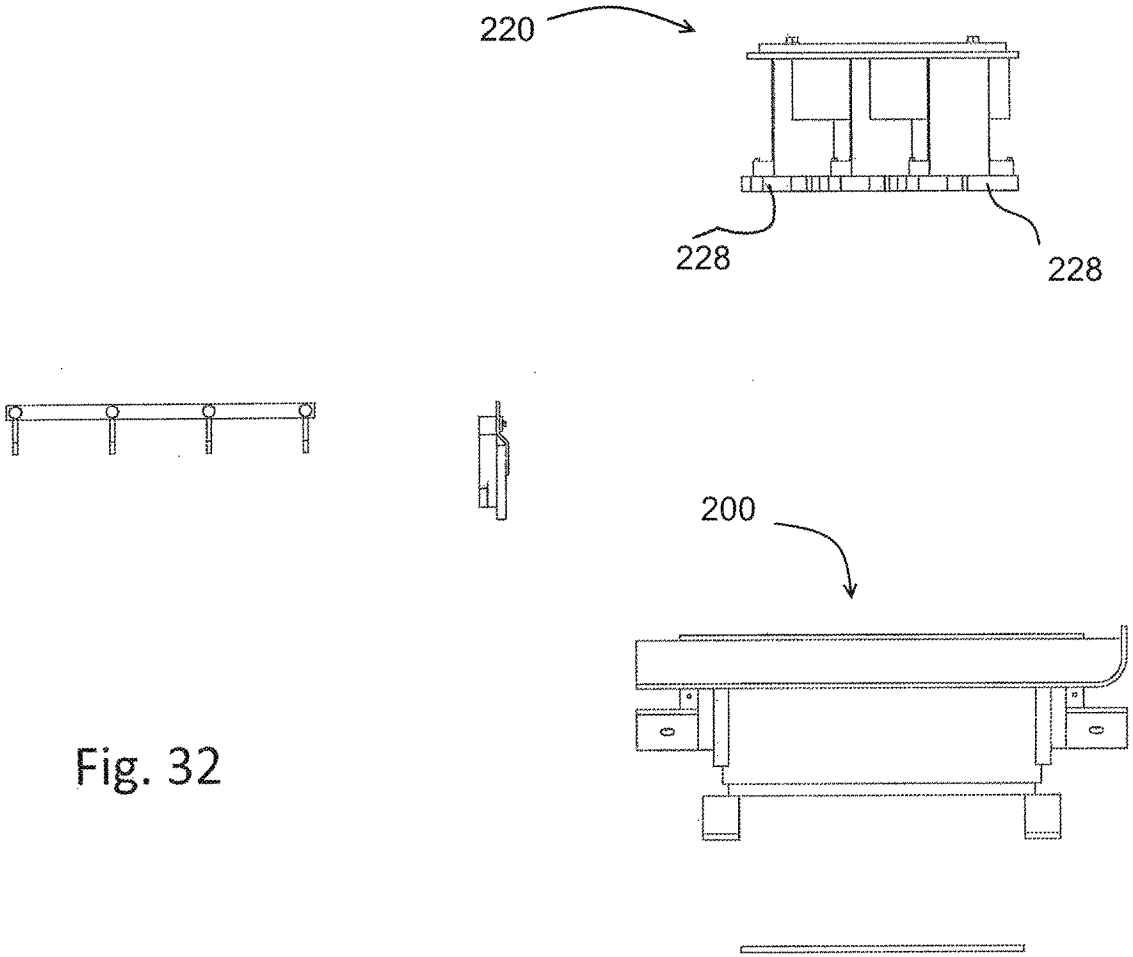
FIG. 32 is a left side elevation view of the molding equipment shown in FIG. 17.
Figure 33:
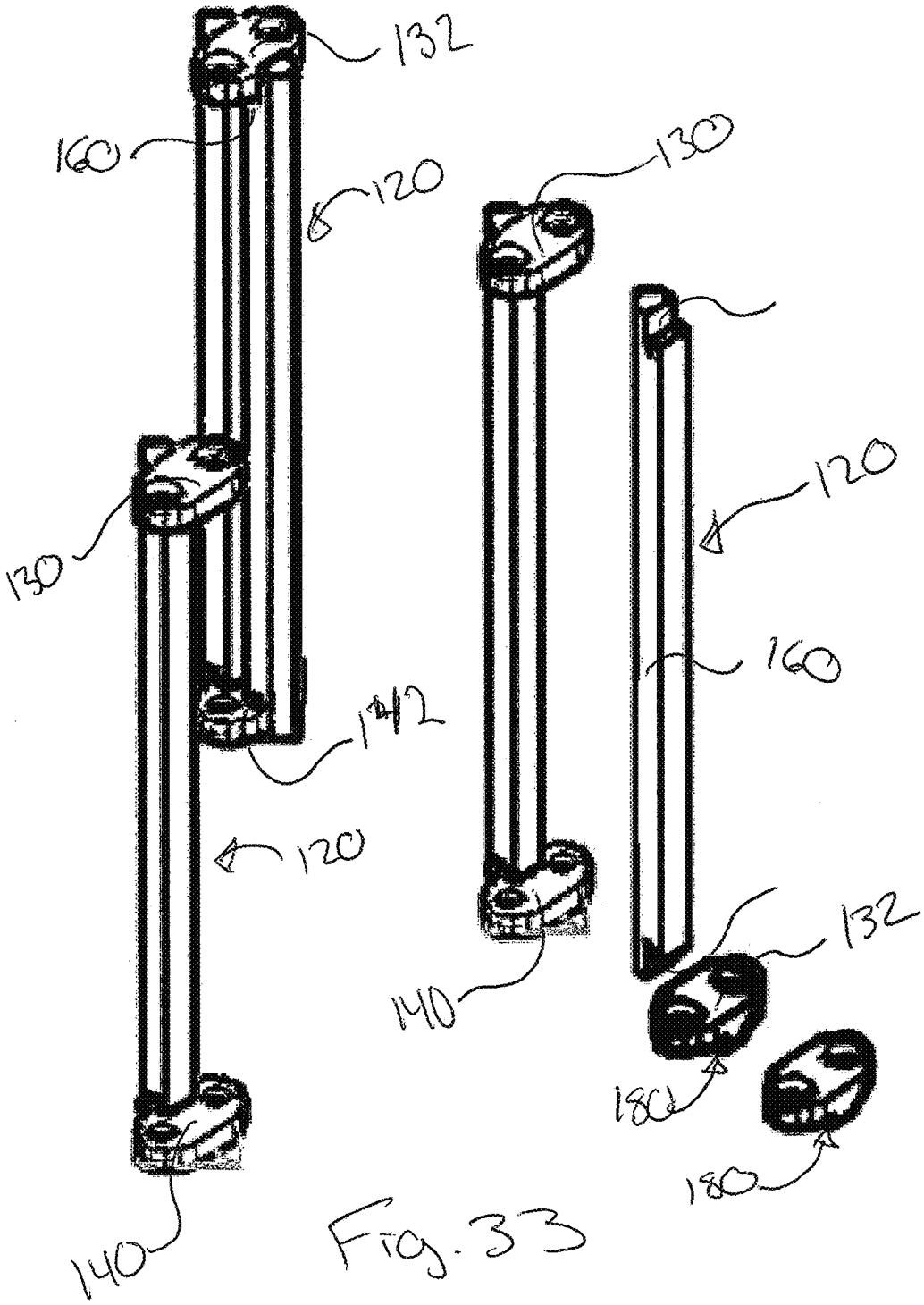
FIG. 33 is a perspective view of the elongated "v" shaped inducing member with securing dogs, omitting the molding cavities.
Figure 34:
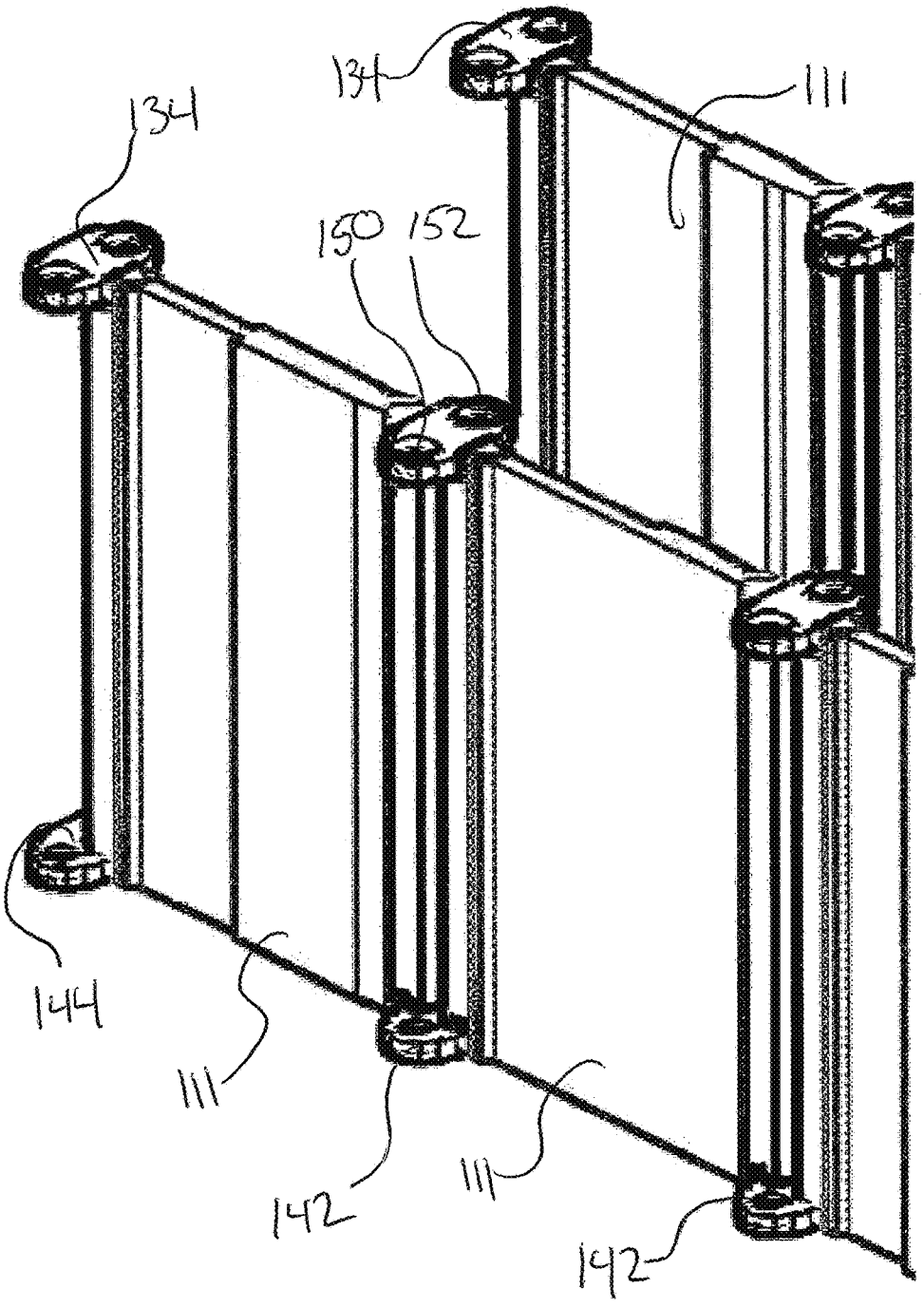
FIG. 34 is a perspective view of separating plates and securing dogs omitting the molding cavities.

Referring to FIGS. 25-31, in the present embodiment, is shown an exemplary separating plate 111 having upper 112, 115 and lower 113, 114 indentation to mate with the securing dogs 130, 132, 134, 140, 142, 144. Also shown in the FIGS. 25 and 26 are texture elements of the plate 195 to mold various design in the bricks.

Understandably, one mold may use various or identical separating plates 111. Using identical plates 111 will result in identical stackable inter-engaging brinks whereas using different plates 111 will result in bricks having different designs.

Figure 22:
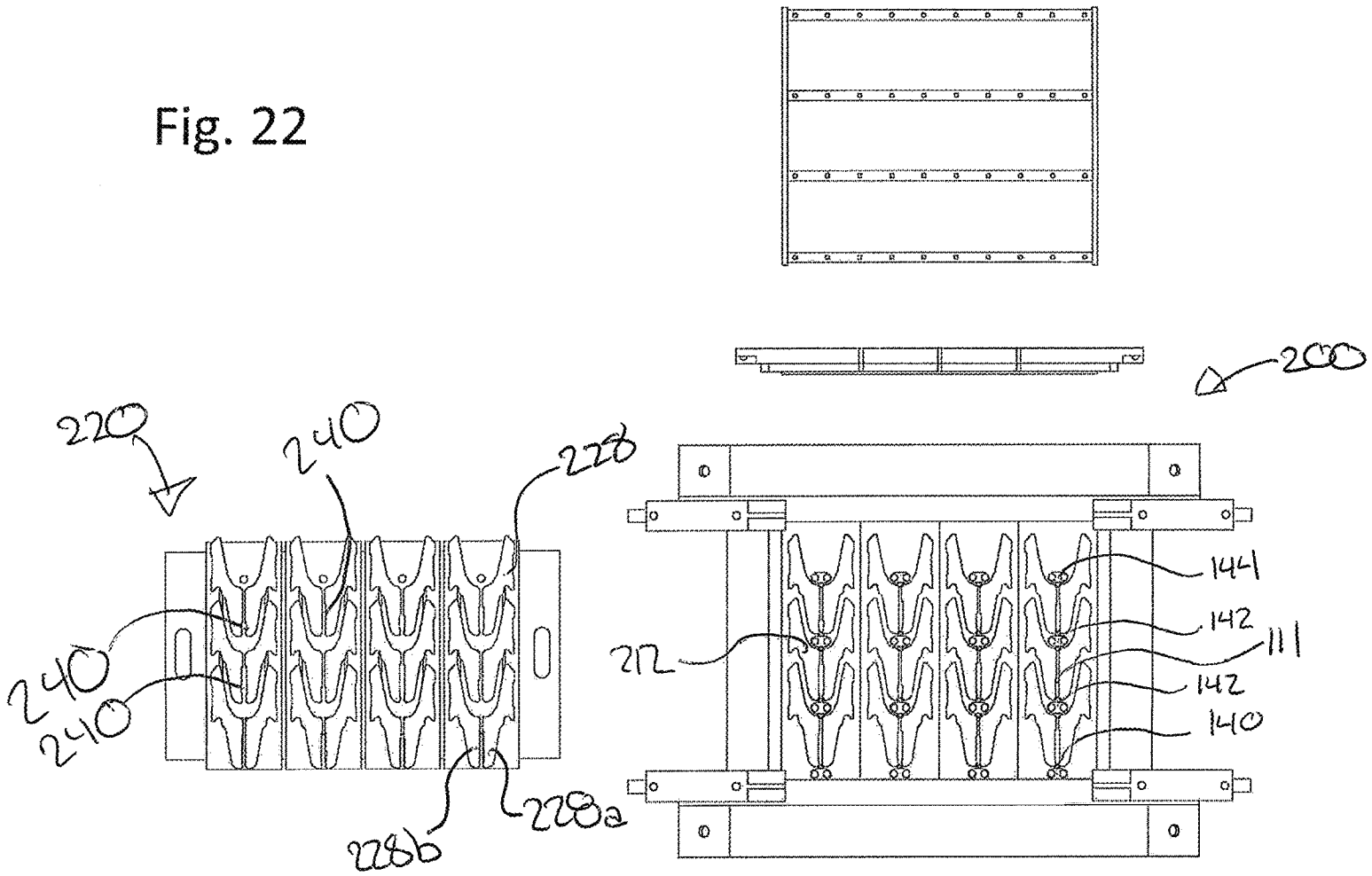
FIG. 22 is bottom plan view of the molding equipment shown in FIG. 17.

Now referring to FIG. 22, according to one embodiment of the present invention, the separating plates 111 are tapered from top to bottom. In other words, the upper portion of the separating plates 111 is wider than the lower portion. Accordingly, the upper portion of the mold cavity 401, the bricks are smaller than in the lower portion 402, thus promoting easy removal of the uncured brick from the mold. The smooth, embossed or textured plates 111 may all be tapered to promote easy brick removal. For example, a taped from a ¼ inch at the upper portion to the plate to a 3⁄16 inches at the bottom was found to be suitable for adequate removal of the bricks form the mold. Understandably, the degree of tapering will vary with the size and material of the bricks.

Referring to FIG. 25, the upper portion 601 will preferably be wider than the lower portion 602 of the separating plates.

Although the molding equipment and method for molding stackable inter-engaging bricks with smooth or embossed face has been described with a certain degree of particularity, it is to be understood that the disclosure has been made by way of example only and that the present invention is not limited to the feature embodiment(s) described and illustrated herein, but includes all variations and modifications within the scope and spirit of the invention as hereinafter claimed.

While illustrative and presently preferred embodiments of the invention have been described in detail hereinabove, it is to be understood that the inventive concepts may be otherwise variously embodied and employed and that the appended claims are intended to be construed to include such variations except insofar as limited by the prior art.

The invention claimed is:

1. A molding equipment for molding multiple pairs of individual stackable inter-engaging bricks, the molding equipment comprising:

a frame supporting a plurality of mold blocks arranged side by side over a flat surface and along a first direction, each mold block comprising distinct main cavities arranged in a row extending along a second direction perpendicular to the first direction, and each main cavity defined by substantially vertical cavity walls extending toward the flat surface from a top mold block surface to a bottom mold block surface;

a plurality of grooves defined in each mold block to extend from said top to bottom surfaces, a set of the grooves in each mold block extending along the second direction and between each main cavity thereof;

a plurality of separating plates distinct from the mold blocks, each main cavity being split into two substantially symmetric sub-cavities by mating opposed protruding edges of each plate into respective grooves of said groove set, whereby each of two opposed brick-shaping surfaces of each plate defines a sub-cavity wall extending from said top to bottom surfaces; and a plurality of sets of upper and lower dogs securing the separating plates to a respective one of said mold blocks, each upper and lower dog having a securing element on one side thereof mating with one of said plates at an edge thereof, and at least some of the upper and lower dogs having a securing element on an opposing side thereof mating with another one of said plates at an edge thereof.

2. The molding equipment of claim 1, wherein the separating plates are secured to the top and bottom surfaces of a respective one of said mold blocks.

3. The molding equipment of claim 1, wherein each of said rows comprises end main cavities located at opposite mold block ends along the second direction and intermediate main cavities located between the main end cavities, whereby separating plates splitting end main cavities are mounted at one edge by end mounting dogs having one of said securing elements and at another edge by intermediate mounting dogs having both of said securing elements, the second of said securing elements mounting an edge of a separating plate splitting one of the intermediate main cavities.

4. The molding equipment of claim 3, wherein each separating plate splitting adjacent main cavities in a respective mold block is mounted to the mold block using intermediate mounting dogs.

5. The molding equipment of claim 1, wherein the frame comprises:

longitudinal bars extending along the first direction on two opposing sides of the plurality of mold blocks; and lateral support plates extending along the second direction between the longitudinal bars on two other opposing sides of the plurality of mold blocks, the lateral support plates being mounted to the longitudinal bars for securing the plurality of mold blocks together during molding.

6. The molding equipment of claim 1, wherein the plurality of mold blocks are secured to the longitudinal bars.

7. The molding equipment of claim 1, wherein the separating plates are interchangeable.

8. The molding equipment of claim 1, wherein the separating plates each have an upper and lower securing element of said protruding edge, the upper and lower plate securing elements mating with the securing elements of upper and lower dogs respectively.

9. The molding equipment of claim 1, wherein the separating plates are designed to be interchangeable with a pair of groove forming elements, the groove forming elements having a protruding portion defined by a v-shaped cross-section extending from said top to bottom surfaces, and each protruding portion being mateably receivable in a respective one of said mold block grooves to be secured using respective mounting dogs.

10. The molding equipment of claim 1, further comprising a brick extraction module for extracting the bricks after casting, the brick extraction module comprising an upper plate mounted to a lower heads substantially corresponding to the shape of the bricks.

11. The molding equipment of claim 1, wherein the main cavities are identical to one another and the sub-cavities are identical to one another.

12. The molding equipment of claim 1, wherein the mold blocks are identical to one another.

13. The molding equipment of claim 1, wherein the separating plates are made from metal.

14. The molding equipment of claim 13, wherein the metal is cast iron or steel.

15. The molding equipment of claim 1, wherein each of the brick-shaping surfaces is smooth.

16. The molding equipment of claim 1, wherein each of the brick-shaping surfaces is embossed.

17. The molding equipment of claim 16, wherein the embossed surfaces comprise projections and/or cavities.

18. The molding equipment of claim 1, wherein the sub-cavities are defined to mold the bricks on side surfaces thereof, each brick having a ratio of the side surface to brick length of 26.65:1, whereby the bricks having said ratio can be unmolded in an uncured form without falling down, being damaged, buckling, or otherwise deforming.

19. The molding equipment of claim 1, wherein each of said securing elements is an indentation.

* * * * *